US007686864B2

(12) United States Patent
Smirnov et al.

(10) Patent No.: US 7,686,864 B2
(45) Date of Patent: Mar. 30, 2010

(54) METHOD FOR THE MANUFACTURE OF LIQUID-METAL COMPOSITE CONTACT

(76) Inventors: Yuriy Smirnov, 8 Shumskogo Str., Apt. 308, Kiev (UA) 02098; Valeriy Skorokhod, 94-96, Gorkogo Str., Apt. 48, Kiev (UA) 03150; Sergiy Chernyshov, 15, Kulturiy Str., Apt. 79, Kharkov (UA) 61166

( * ) Notice: Subject to any disclaimer, the term of this patent is extended or adjusted under 35 U.S.C. 154(b) by 180 days.

(21) Appl. No.: 11/909,371

(22) PCT Filed: Mar. 30, 2005

(86) PCT No.: PCT/UA2005/000013

§ 371 (c)(1),
(2), (4) Date: Sep. 21, 2007

(87) PCT Pub. No.: WO2006/101464

PCT Pub. Date: Sep. 28, 2006

(65) Prior Publication Data

US 2008/0196547 A1 Aug. 21, 2008

(30) Foreign Application Priority Data

Mar. 23, 2005 (UA) ..... A 200502650

(51) Int. Cl.
*C22B 5/00* (2006.01)

(52) U.S. Cl. ..... 75/330
(58) Field of Classification Search ..... 75/330
See application file for complete search history.

(56) References Cited

U.S. PATENT DOCUMENTS 5,391,846 A 2/1995 Taylor et al.
2003/0209414 A1 11/2003 Wong

FOREIGN PATENT DOCUMENTS

UA 62376 A 12/2003

*Primary Examiner*—Roy King
*Assistant Examiner*—Yoshitoshi Takeuchi
(74) *Attorney, Agent, or Firm*—DeLio & Peterson, LLC; Peter W. Peterson

(57) ABSTRACT

A method of manufacturing liquid-metal composite contacts, where fabric of high-melting metal based wire is in the form of a strip, rolled into a cylindrical workpiece, and installed into a matrix. The workpiece is then pressed, reduced in an environment of hydride hydrogen in a vacuum furnace, and soaked with low-melting metal or alloy, where the soaking of the structure is performed with three metals, tin (Sn), indium (In) and gallium (Ga) within three sequential stages lasting 10 to 20 minutes each, namely, the structure is first soaked with liquid tin at a temperature of 750 to 1150° C., then with liquid indium at the temperature of 750 to 1000° C., and third with liquid gallium at the temperature of 700 to 900° C. The amount of liquid tin, indium, and gallium is proportional to eutectic mixture and volume of the pores in the structure.

1 Claim, 3 Drawing Sheets

METHOD FOR THE MANUFACTURE OF LIQUID-METAL COMPOSITE CONTACT

BACKGROUND OF THE INVENTION

1. Field of the Invention

The present invention pertains to electrical engineering, namely to manufacturing of electric devices, and in particular, to methods for manufacture of liquid-metal composite contacts used in switching units in, preferably, power networks, including vacuum switching units.

2. Description of the Related Art

In terms of technological essence, the method for manufacture of liquid-metal composite contact comprising the stages of producing fabric of high-melting metal based wire, where fabric is in the form of a strip having the arranged structure, rolling said fabric into cylindrical workpiece and installing it into a matrix, pressing the workpiece to obtain the structure having desired dimensions, reduction of the structure in the environment of the hydride hydrogen obtained in a vacuum furnace, soaking the structure with low-melting alloy in the hydride hydrogen environment (Declarative Patent of Ukraine for invention No. 62376A, IPC$^7$ H01H 9/00, Publ. 15.12.2003, Bul. No. 12, 2003) is the closest to the proposed method. In the described method, the structure is produced of tungsten, molybdenum and rhenium based alloys.

The drawback of the described method is in insufficient soaking of the porous structure by low-melting alloy due to insufficient wettability of high-melting metal of the structure by low-melting alloy. This results in nonuniformity of the transient electric resistance across the contact section, causing appearance of the overheating zones and early degradation of the structure.

SUMMARY OF THE INVENTION

The purpose of the invention is to propose such method for manufacture of liquid-metal composite contact, which would improve the soaking of the porous high-melting metal structure with low-melting metal due to enhanced adhesive strength at low-melting metal/high-melting metal border, with high-melting metal being the material of the structure, which would be attained by creating conditions for better structure metal wettability by low-melting metal.

The problem is solved by the proposed method, which, like the known method for manufacture of liquid-metal composite contact, comprises the stages of producing fabric of high-melting metal based wire, where fabric is in the form of a strip having the arranged structure, rolling said fabric into cylindrical workpiece and installing it into a matrix, pressing the workpiece to obtain the structure having desired dimensions, reduction of the structure in the environment of the hydride hydrogen obtained in a vacuum furnace, soaking the porous structure with low-melting metal or alloy performed in the hydride hydrogen environment within the same vacuum furnace, and the invention is characterized in that the operation of soaking the structure is performed with three metals, i.e. tin (Sn), indium (In) and gallium (Ga) in the hydride hydrogen environment within three sequential stages lasting 10 to 20 minutes each, namely, at the first stage the structure is soaked with liquid tin (Sn) at the temperature of 750 to 1150° C., at the second stage the structure is soaked with liquid indium (In) at the temperature of 750 to 1000° C., and at the third stage the structure is soaked with liquid gallium (Ga) at the temperature of 700 to 900° C., and the amount of liquid tin (Sn), indium (In) and gallium (Ga) used is selected to be proportional to eutectic mixture and volume of the pores in the structure.

The amount of liquid tin (Sn), indium (In) and gallium (Ga) is selected to be proportional to eutectic mixture, namely: Sn-13%, In-25%, Ga-62%, and volume of the pores in the structure. At +10° C. such mixture is in liquid state and actively reacts with air oxygen.

The method aims at creating conditions to exclude unwanted impurities, primarily oxides, of the W—Sn—In—Ga, Re—Sn—In—Ga, Mo—Sn—In—Ga heterogeneous systems during the structure soaking, as such oxide impurities significantly decrease the adhesive strength at low-melting metal/high-melting metal border and, therefore, decreases the structure wettability by low-melting metal. The authors have been experimenting for many years and have found the optimum conditions for soaking the structure made of high-melting wire and defined the sequence comprising said three stages.

DESCRIPTION OF THE PREFERRED EMBODIMENT(S)

Liquid-metal composite contact comprises porous structure 1 produced of high-melting metal wire in the form of fabric with the arranged structure of "elastic" type soaked with low-meting metals 2. Linear size h of the structure 1 pores is defined as h=(2 . . . 5)D, D=10 . . . 70 μm, where D is diameter of high-melting metal wire. After pressing, the structure 1 has the form of elastic cylinder with one edge intended to contact the lead wire and the other edge intended to contact another identical contact (not shown).

Figure 1:
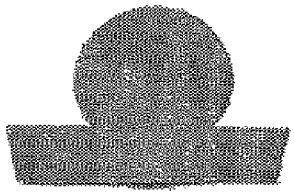
FIG. 1 illustrates the profile of liquid tin drop on a flat horizontal tungsten surface at the temperature 550 to 700° C. in vacuum.
Figure 2:
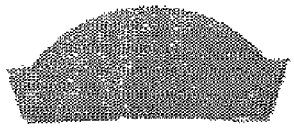
FIG. 2 illustrates the profile of liquid tin drop on a flat horizontal tungsten surface at the temperature 700° C. in vacuum after holding it for 40 minutes.
Figure 3:
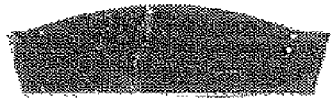
FIG. 3 illustrates the profile of liquid tin drop on a flat horizontal tungsten surface at the temperature 950° C. in hydride hydrogen environment.
Figure 4:
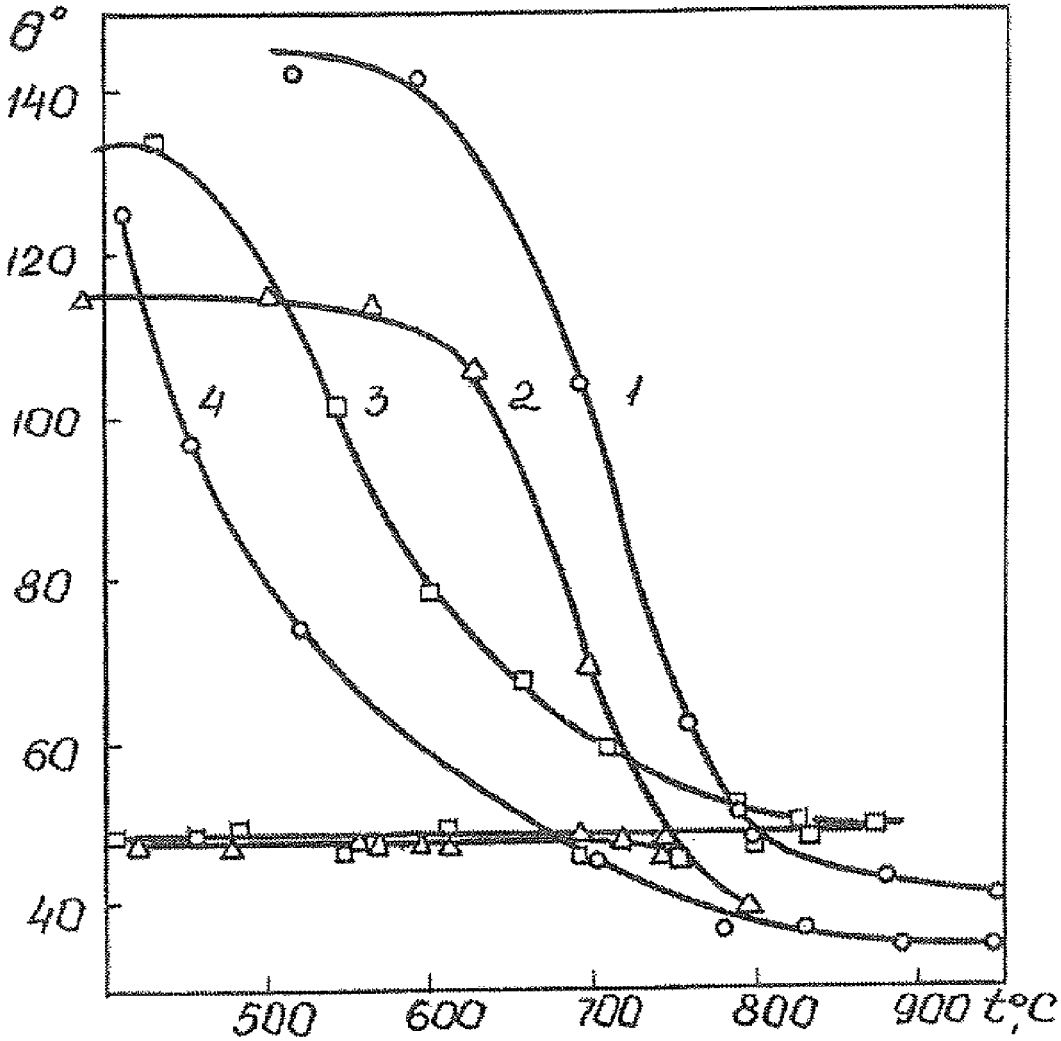
FIG. 4 illustrates the tungsten and rhenium wettability by liquid tin as a function of temperature. Diagram 1 shows tungsten wettability by liquid tin in vacuum; diagram 2 shows tungsten wettability by liquid tin in hydride hydrogen environment; diagram 3 shows rhenium wettability by liquid tin in vacuum; diagram 4 shows rhenium wettability by liquid tin in hydride hydrogen environment.
Figure 5:
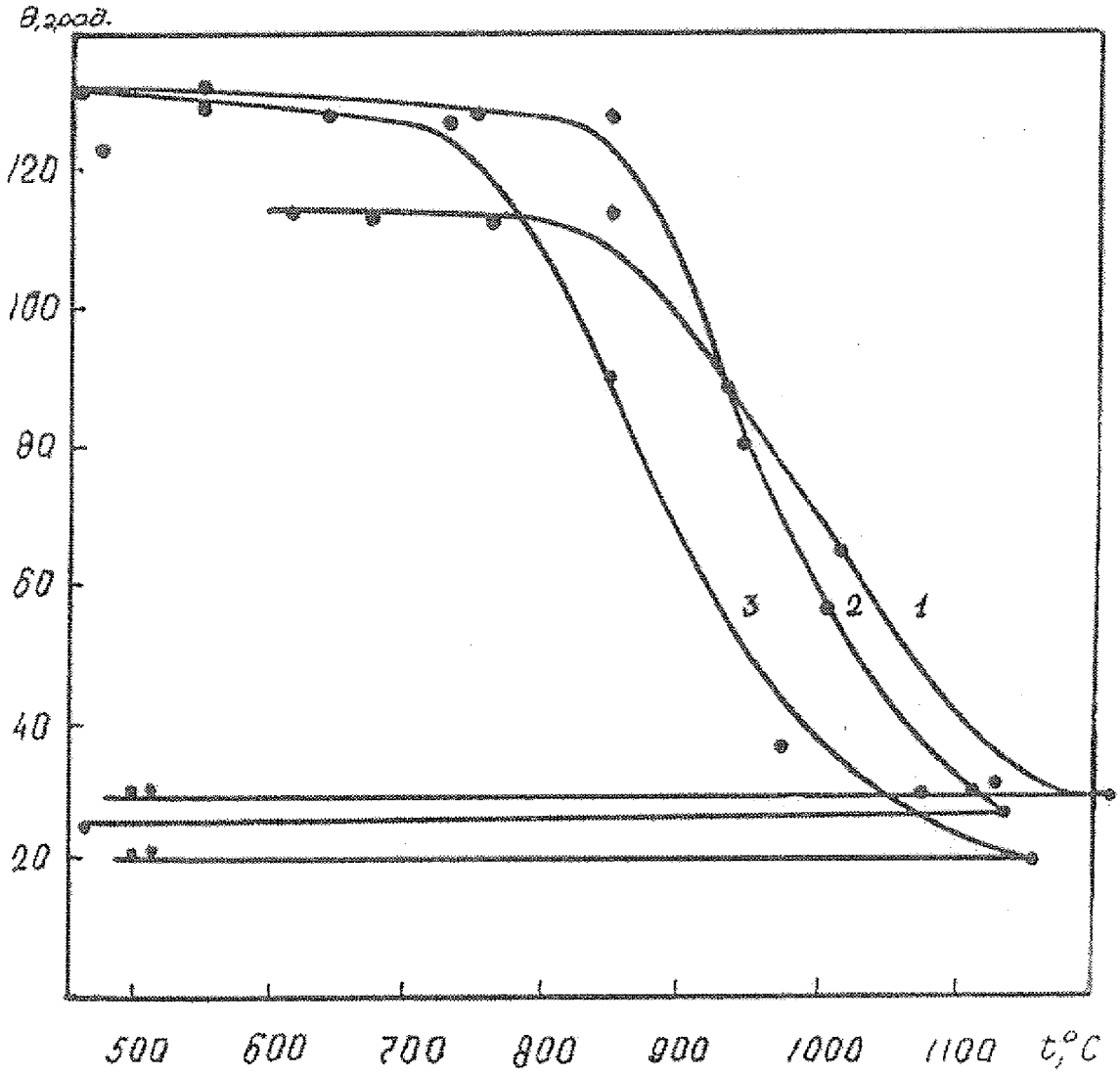
FIG. 5 illustrates molybdenum wettability by liquid tin as a function of temperature. Diagram 1 shows molybdenum wettability by liquid tin in helium (He) environment; diagram 2 shows molybdenum wettability by liquid tin in vacuum; diagram 3 shows molybdenum wettability by liquid tin in hydride hydrogen environment.
Figure 6:
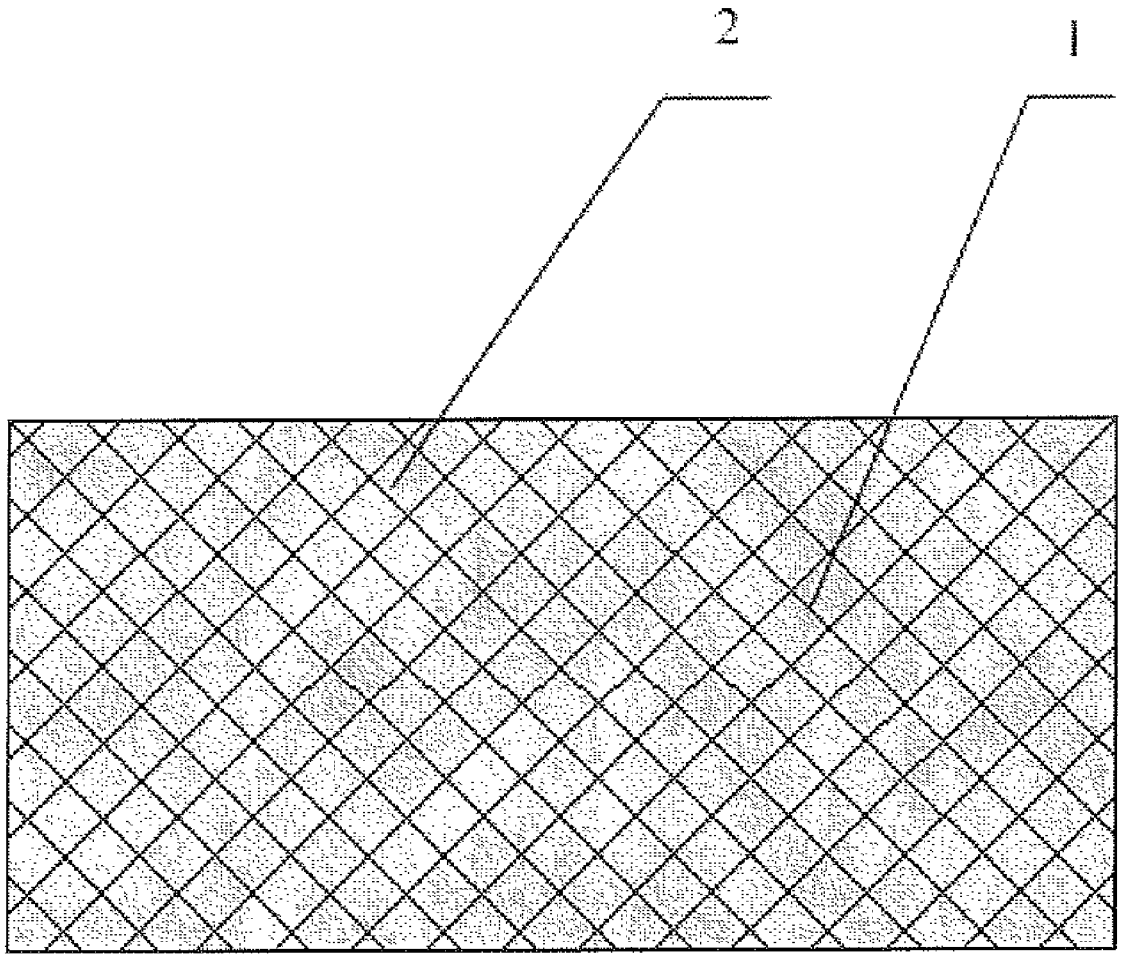
FIG. 6 illustrates construction of the liquid-metal composite contact.

Experimental results (FIG. 1) show that thermal vacuum annealing (FIG. 1 and FIG. 2) at a temperature in the range of 550 to 700° C. in vacuum during 40 minutes causes impurities to be removed from the inter-phase border, thus tungsten wettability by tin is significantly improved, while tungsten wettability by tin is even better in hydride hydrogen environment (FIG. 3) than in vacuum. FIGS. 4 and 5 depict the wettability of tungsten, rhenium and molybdenum by liquid tin as a function of temperature. One can see that the wettability threshold for tungsten, rhenium and molybdenum shifts to lower temperatures zone by 50-100° C. in hydride hydrogen environment. Experimental results show that thermal vacuum annealing (FIGS. 1 and 2) at a temperature in the range of 550 to 700° C. in vacuum during 40 minutes causes impurities to be removed from the inter-phase border, thus tungsten wettability by tin is significantly improved, while tungsten wettability by tin is even better in hydride hydrogen environment (FIG. 3) than in vacuum. FIG. 4 depicts the wettability of tungsten and rhenium by liquid tin as a function of temperature. One can see that the wettability threshold for tungsten and rhenium shifts to lower temperatures zone in hydride hydrogen environment compared to vacuum. The wettability threshold is defined as temperature interval where the wettability angle decreases from 90° to equilibrium, which is 20-50° in our case (FIG. 4, 5), and remains unchanged with temperature increase. Tungsten wetting by tin-gallium alloys was also studied.

The author have experimentally determined the optimum conditions for the proposed method. We have studied the surface properties of low-melting metal alloys contacting high-melting metals. Wettability of tungsten, molybdenum and rhenium by liquid tin (Sn), indium (In), gallium (Ga) and their alloys was studied in vacuum, helium environment and hydride hydrogen environment in the temperature range of 450 to 1200° C. The alloys were prepared of high purity tin, indium and gallium (at least 99.9% of the main components). High-melting metals used were tungsten, molybdenum and rhenium produced by zone melting method. Profile of liquid metal drop was registered on photographic plate and wetting angle was visually measured using a microscope. Experimental results (FIGS. 1-5) show that thermal vacuum annealing (FIGS. 1 and 2) at a temperature in the range of 550 to 700° C. in vacuum during 40 minutes causes impurities to be removed from the inter-phase border, thus tungsten wettability by tin is significantly improved, while tungsten wettability by tin is even better in hydride hydrogen environment (FIG. 3) than in vacuum. FIG. 4 depicts the wettability of tungsten and rhenium by liquid tin as a function of temperature. One can see that the wettability threshold for tungsten and rhenium shifts to lower temperatures zone in hydride hydrogen environment compared to vacuum. The wettability threshold is defined as temperature interval where the wettability angle decreases from 90° to 20-50° (in our case) and remains unchanged with further increase of temperature.

Tungsten wetting by liquid tin-gallium alloys was studied. We have found out that increase of tin content in gallium up to 15 weight % causes the wetting threshold to shift toward lower temperatures compared to pure gallium but beyond the wetting threshold the contact angle is larger compared to pure gallium.

The researchers have studied molybdenum and tungsten wetting by liquid tin-indium alloys in various gaseous environments. We have found that molybdenum is better wetted by pure indium and indium-tin alloys than tungsten.

We have studied the conditions of soaking the porous structures made of high-melting metals: tungsten, molybdenum and rhenium.

Liquid tin better wetted (at the first stage) the structures made of high-melting metals: tungsten, molybdenum and rhenium in hydride hydrogen environment at the temperature of 750 to 1050° C.

At the second stage high-melting structure previously wetted and soaked by liquid tin is soaked by liquid indium. The optimum conditions for soaking by indium turned to be hydride hydrogen environment and temperature range of 750 to 1000° C.

At the third stage the soaking of the structures made of the above mentioned high-melting metals by eutectic Sn—In mixture was followed by liquid gallium (Ga) soaking. The optimum conditions turned to be hydride hydrogen environment and temperature range of 700 to 900° C.

In hydride hydrogen environment at the above temperatures liquid metals indium (In) and gallium (Ga) better wet such high-melting metals as tungsten, molybdenum and rhenium but worse than tin. Therefore, the sequence of soaking operations consists of three stages of the structure soaking, namely, by liquid tin (Sn) at the first stage, by liquid indium (In) at the second stage, by liquid gallium (Ga) at the third stage. The process lasts for 10 to 20 minutes at each stage. Duration less than 10 minutes does not provide satisfactory results while duration in excess of 20 minutes is not economically justified as the soaking process practically finishes within 20 minutes. The temperature conditions for each stage were determined experimentally. There is practically no soaking at the temperature below 750° C., while temperatures above 1050° C. do not result in significant enhancement of soaking. In addition, we have found out that temperatures above 1200° C. significantly decrease the strength of high-melting structure, therefore, the upper temperature limit for each stage is 1050° C.

Eutectic mixture is a mixture of two or more substances in such a proportion that melting point of the mixture is the lowest among melting points of these substances in another proportions (The Big Explanatory Dictionary of Ukrainian Language. Comp. and Ed. V. T. Busel, K. Irpen, VTF "Perun", 2003, 254 p.). Therefore, the amount of liquid tin (Sn), indium (In) and gallium (Ga) is selected to be proportional to eutectic mixture (13% Sn, 25% In, 62% Ga) and volume of the structure pores.

The proposed method is intended for producing contact with structures manufactured of a wire made of a high-melting metal: tungsten (W), molybdenum (Mo) or rhenium (Re).

Composite liquid-metal contacts possess certain advantages over solid metal ones. Among these advantages we can mention low transition resistance, small contact force; absence of vibration and welding, absence of contact sealing; ability to operate at high pressures, acceleration up to 10 g, in vacuum; such contacts may be used for switching kiloampere range currents.

Example 1

Liquid-metal composite contact was manufactured. Namely, tungsten wire was used to produce the fabric in the form of a strip having the arranged structure. The strip was rolled to form cylindrical workpiece, which was installed into a matrix. Then the workpiece was pressed to obtain the structure 1 of the necessary dimensions. The structure 1 was reduced in the hydride hydrogen environment produced in a vacuum furnace. The structure 1 made of high-melting metal wire was soaked with three low-melting metals 2, i.e. tin (Sn), indium (In) and gallium (Ga) in the hydride hydrogen environment within three sequential stages lasting 10 to 20 minutes each, namely, at the first stage the structure was soaked with liquid tin (Sn) at the temperature of 950° C., at the second stage the structure was soaked with liquid indium (In) at the temperature of 900° C., and at the third stage the structure was soaked with liquid gallium (Ga) at the temperature of 750 to 800° C., and the amount of liquid tin (Sn), indium (In) and gallium (Ga) used was selected to be proportional to eutectic mixture and volume of the pores in the structure 1.

Example 2

Liquid-metal composite contact was manufactured. Namely, molybdenum wire was used to produce the fabric in the form of a strip having the arranged structure. The strip was rolled to form cylindrical workpiece, which was installed into a matrix. Then the workpiece was pressed to obtain the structure 1 of the necessary dimensions. The structure 1 was reduced in the hydride hydrogen environment produced in a vacuum furnace. The structure 1 made of high-melting metal was soaked with three low-melting metals 2, i.e. tin (Sn), indium (In) and gallium (Ga) in the hydride hydrogen environment within three sequential stages lasting 10 to 20 minutes each, namely, at the first stage the structure was soaked with liquid tin (Sn) at the temperature of 1100° C., at the second stage the structure was soaked with liquid indium (In) at the temperature of 850 to 1000° C., and at the third stage the structure was soaked with liquid gallium (Ga) at the temperature of 800° C., and the amount of liquid tin (Sn), indium (In) and gallium (Ga) used was selected to be proportional to eutectic mixture and volume of the pores in the structure 1.

Example 3

Liquid-metal composite contact was manufactured. Namely, rhenium wire was used to produce the fabric in the form of a strip having the arranged structure. The strip was rolled to form cylindrical workpiece, which was installed into a matrix. Then the workpiece was pressed to obtain the structure 1 of the necessary dimensions. The structure 1 was reduced in the hydride hydrogen environment produced in a vacuum furnace. The porous structure 1 was soaked with three low-melting metals 2, i.e. tin (Sn), indium (In) and gallium (Ga) in the hydride hydrogen environment within three sequential stages lasting 10 to 20 minutes each, namely, at the first stage the structure was soaked with liquid tin (Sn) at the temperature of 1050° C., at the second stage the structure was soaked with liquid indium (In) at the temperature of 950° C., and at the third stage the structure was soaked with liquid gallium (Ga) at the temperature of 900° C., and the amount of liquid tin (Sn), indium (In) and gallium (Ga) used was selected to be proportional to eutectic mixture and volume of the pores in the structure 1.

Liquid-Metal Composite Contact Operates as Follows.

Part of the contact is fixed in a contact holder (not shown). The second part of the contact is the contacting part which along with identical contact conducts and switches electric current. The proposed contact possesses a number of advantages compared to a conventional liquid-metal composite contact. The main advantage is the increased area of continuous surface contact due to liquid metal phase (Sn—In—Ga), which enables 2.5 to 3 times increase in the rated current, longer service life due to decreased contact pressure down to 100-140 N, absence of contact welding possibility under critical conditions (i.e. short circuit), decrease in transition resistance.

The above advantages are attained due to improvement in porous structure 1 soaking by low-melting metal 2 and increasing the adhesive strength of the borders of W—Sn—In—Ga, Re—Sn—In—Ga, Mo—Sn—In—Ga heterogeneous systems by way of removing unwanted impurities, primarily oxides, during the structure 1 soaking by low-melting metal 2.

The invention claimed is:

1. A method for manufacture of liquid-metal composite contacts comprising:

producing fabric of high-melting metal-based wire;

rolling said fabric into a cylindrical workpiece and installing said fabric into a matrix;

pressing said workpiece to obtain a structure having desired dimensions;

reducing said structure within a vacuum furnace in an environment of hydrogen obtained from metal hydride; and soaking said structure in three sequential stages lasting ten to twenty minutes each with a low-melting metal or alloy in said hydride hydrogen environment within said vacuum furnace, said low-melting metal or alloy including tin (Sn), indium (In), and gallium (Ga), the structure being soaked in a first stage with liquid tin (Sn) at a temperature of 750° C. to 1100° C., the structure being soaked in a second stage with liquid indium (In) at a temperature of 750° C. to 1000° C., and the structure being soaked in a third stage with liquid gallium (Ga) at a temperature of 700° C. to 900° C., the amount of said liquid tin (Sn), said liquid indium (In), and said liquid gallium (Ga) used being selected to be proportional to a eutectic mixture and volume of pores in said structure.

* * * * *